United States Patent [19]

Crain

[11] Patent Number: 4,787,586

[45] Date of Patent: Nov. 29, 1988

[54] CONTAINER SUPPORT DEVICE

[76] Inventor: W. Kenneth Crain, P.O. Box 691, Cherryville, N.C. 28021

[21] Appl. No.: 868,373

[22] Filed: May 29, 1986

[51] Int. Cl.[4] ..... E06C 7/14

[52] U.S. Cl. ..... 248/210; 248/311.2; 248/315

[58] Field of Search ..... 248/211, 210, 311.2, 248/315, 300, 302; 182/121, 129

[56] References Cited

U.S. PATENT DOCUMENTS

| | | | |
|---|---|---|---|
| 261,618 | 7/1882 | Lufkin | 248/303 |
| 686,159 | 11/1901 | Sprague | 248/238 X |
| 1,772,392 | 8/1930 | Firl | 248/210 |
| 2,912,204 | 11/1959 | Raysinger | 248/210 |
| 3,009,677 | 11/1961 | Munnikhuysen | 248/210 X |
| 3,051,428 | 8/1962 | Schult | 248/311.2 X |
| 3,738,601 | 6/1973 | Gehringer | 248/210 |
| 3,809,351 | 5/1974 | Bravo et al. | 248/210 |
| 3,895,772 | 7/1975 | Ellingson | 248/210 |
| 4,403,368 | 9/1983 | Harper | 248/210 X |
| 4,534,528 | 8/1985 | Rousseau | 248/210 |

FOREIGN PATENT DOCUMENTS

| | | | |
|---|---|---|---|
| 400177 | 8/1924 | Fed. Rep. of Germany | 248/210 |

*Primary Examiner*—David L. Talbott

*Attorney, Agent, or Firm*—Ralph H. Dougherty

[57] ABSTRACT

A container support device for attachment to a ladder, particularly to support paint can or buckets. A paint bucket is suspended in receiving notches between elongate vertical members, and can swing freely to maintain the bucket rim level even if the angular position of the ladder is changed. The vertical members are adapted for attachment to an upper ladder rung and to rest against a lower rung. An adapter for using the device with smaller paint cans is also disclosed.

2 Claims, 2 Drawing Sheets

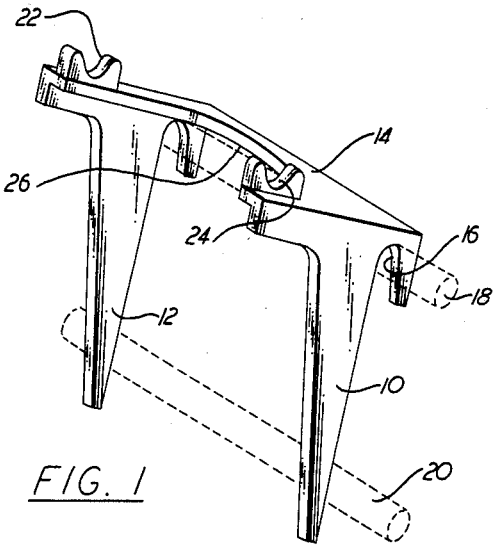
FIG. 1
FIG. 2
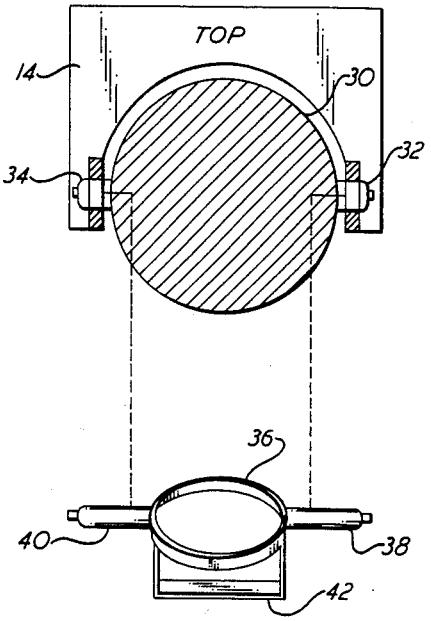
FIG. 3
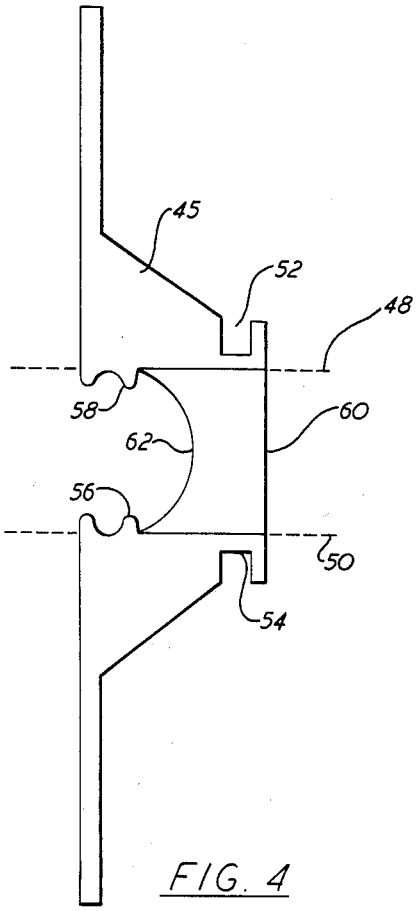
FIG. 4
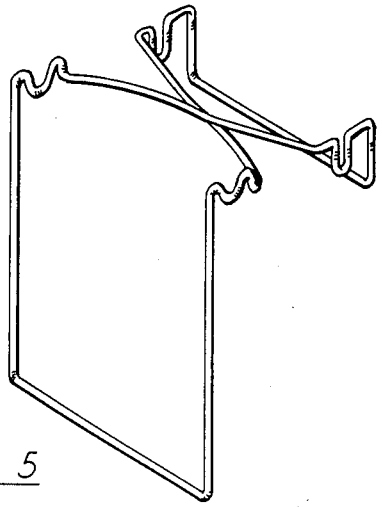
FIG. 5

CONTAINER SUPPORT DEVICE

BACKGROUND OF THE INVENTION

1. Field of the Invention

This invention relates to a support device. More specifically, the invention relates to a support device attachable to a ladder for supporting a paint container in a vertical position as the angular position of the ladder is changed.

2. Description of the Prior Art

A search of the prior art was made prior to the preparation of this patent application. The prior art device most similar to the present invention is believed to be the support device described in U.S. Pat. No. 3,895,772, issued to Erling Ellingson. This support device is described in the patent as comprising a rigid base of sheet material having a hook at one end to hang on a rung of the ladder such that the base sheet engages a lower rung of the ladder to restrain rotation of the base member. Support for the container is provided by brackets positioned between the rungs of the ladder formed by bending portions of the base metal forward.

Other U.S. patents less pertinent to this invention, which were found during a search of the invention, are listed below.

| INVENTOR | U.S. Pat. No. |
|---|---|
| Sprague, C. S. & F. O. | 686,159 |
| Gehringer, Lyle P. | 3,738,601 |
| Harper, Orville R. | 4,403,368 |
| Bravo, Ricardo | 3,809,351 |
| Rousseau, Michel | 4,534,528 |
| Raysinger, J. A. | 2,912,204 |
| Munnikhuysen, J. N. | 3,009,677 |
| Schult, A. W. | 3,051,428 |

No discussion of the above listed patents appears to be necessary in that these patents are believed to be only of secondary interest, at most. Additional patents were cited by the searcher as of interest only. These patents are not included in that they are not believed to be pertinent to the examination of this invention. None of the patents cited above or any combination of these patents show or suggest a support device having the features and characteristics of the support device comprising the invention described herein.

As demonstrated by the above discussion of the prior art, it has long been a problem for painters to position a paint bucket on a ladder such that the paint bucket is both stable and convenient. While each of these prior art devices have advantages, collectively they demonstrate the continuing efforts of those skilled in the art to develop support devices to meet the ever changing needs of painters.

SUMMARY OF THE INVENTION

The preferred embodiment of the invention comprises a support device attachable to a ladder and adapted to support a container, such as a paint bucket, in a vertical position as the angular position of the ladder is changed.

The support device includes two elongate members which are rigidly held in a fixed predetermined spaced relationship to each other by a spacer therebetween. When the support device is attached to a ladder, the elongate members are respectively supported by and snugly abut to an upper and a lower rung of the ladder.

The paint bucket is suspended between the elongate members using the bail mounting brackets and swings freely to maintain the bucket in a vertical position as the angular position of the ladder is changed. Supporting the paint bucket using the bail attachment brackets, which are near the top of a standard paint bucket, further reduces the probability that the paint bucket will be accidently overturned. The design is such that during normal use it is not necessary to remove either the holder or the paint bucket when repositioning the ladder. The holder is of light, durable material and can be of plastic, sheet metal or wire. No tools are necessary to install the holder on the ladder.

Each support device is designed to support a specific size container. However, adapters are provided, permitting the support device to be used to support other sizes of containers.

The fact that the paint bucket is self adjusting to the vertical position as the ladder is moved up and down the side of the object being painted is extremely helpful to the painter. Additionally, the paint bucket is positioned in front of the ladder, that is on the side of the rungs nearer the painter, to provide convenient and unobstructed access to the paint therein.

Paint buckets larger than one gallon in size are seldom used on ladders. For this reason, all development work was done using gallon buckets as the basic size and adapters were used for smaller containers.

OBJECTS OF THE INVENTION

The principal object of the present invention is to provide a support device for a paint bucket or similar container that is attachable to a ladder so that the paint bucket is stable, easily accessable, and which will maintain the bucket in a vertical position at all times.

It is also an object of this invention to provide a paint bucket support device attachable to a ladder which will place the bucket on the same side of the ladder as the painter.

It is also an object of this invention to provide a paint bucket support device attachable to a ladder which is readily movable from room to room and which is held in place by force of gravity.

Another object of this invention is to provide a holder for a paint bucket or similar container that can stabilize the paint bucket while the ladder is being lowered, raised or moved from side to side.

Another object of this invention is to provide a holder for a paint bucket or similar container easily adaptable to support paint buckets of differing sizes without removing the holder from the ladder.

BRIEF DESCRIPTION OF THE DRAWINGS

The foregoing and other objects are readily apparent from referring to the following detailed description and the appended drawings, in which:

FIG. 1 is an isometric drawing illustrating one embodiment of the support device comprising invention.

FIG. 2 is a top view of the embodiment of the invention illustrated in FIG. 1, with a paint bucket positioned thereon.

FIG. 3 is an isometric view of an adapter for supporting a smaller container within the support device.

FIG. 4 is a top view of an alternative embodiment of the support prior to its being formed from a single piece of sheet metal.

FIG. 5 is an isometric view of another alternative embodiment of the support device constructed from a single piece of bent wire.

DETAILED DESCRIPTION OF INVENTION

Figure 6:
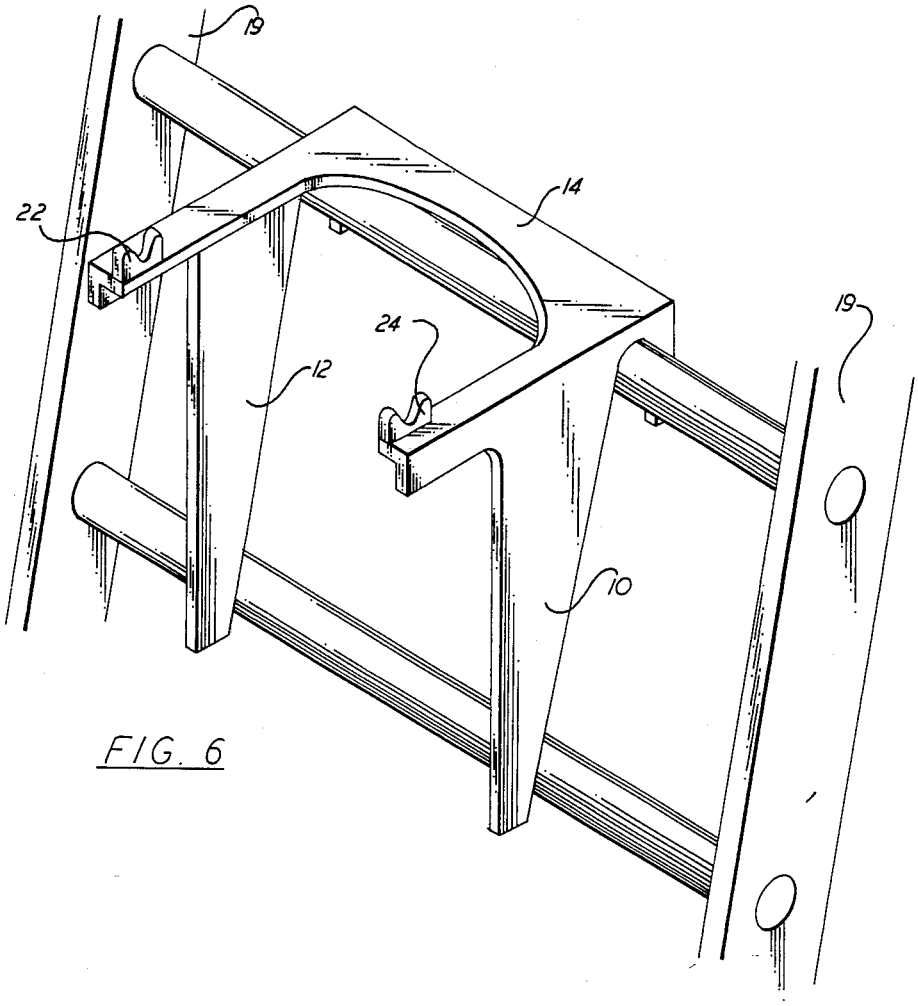
FIG. 6 is an isometric drawing illustrating the support device positioned on a ladder.
Figure 7:
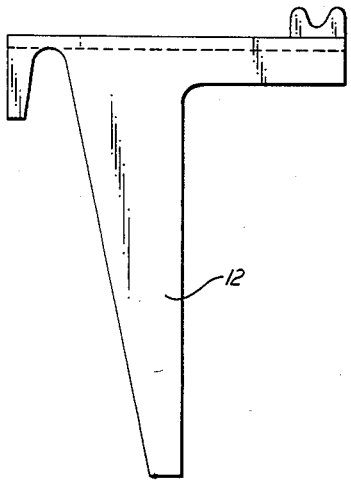
FIG. 7 is a side view of the support device of FIG. 1.

Referring now to FIG. 1, the container support device comprising the invention is depicted showing its relationship to a first upper rung and a second lower rung of a typical ladder, when installed thereon. Similarly, the support device is illustrated as mounted on a ladder in FIG. 6, and in side view in FIG. 7. More particularly, the support device includes first and second downwardly extending elongate members 10 and 12. A spacer 14 extends between and rigidly supports downwardly extending elongate members 10 and 12 in a fixed relationship to each other. Each of the downardly extending elongate members 10 and 12 includes a downwardly facing notch, illustrated with reference to elongate member 10 at reference numeral 16. Positioning the container support device so an upper rung 18 of the ladder is within the notches 16 in the elongate members 10 and 12 attaches the support device to the ladder. Lower ends of the downwardly extending elongate members abut the front side of a second lower rung 20 of the ladder.

Additionally, the support device includes upwardly extending notched portions 22 and 24. A generally curved opening 26 extends inwardly from the front edge of the spacer 14. In use, the paint bucket is supported in the notched portions 22 and 24 such that it exerts a downward force on the support device causing downward extending elongate members 10 and 12 to tend to rotate about the upper rung 18 of the ladder until the downward extending portions contact the lower rung 20 of the ladder. By properly selecting the dimensions of the container support device, the angle of the ladder can be changed from vertical to substantially horizontal in either direction while the container remains a vertical position. That is, the ladder can be positioned at any usable angle while the paint bucket is maintained in a vertical position. In the preferred embodiment the notches 20 and 24 are positioned near the upper end of elongate members 10 and 12 and forward (toward the user) from the upper rung 18 of the ladder. This positions the paint bucket at a convenient location for the user. The relative position of the downward extending notches 16 to the upward extending notches 22 and 24 determines the angle through which the ladder can be changed while the lower ends of the elongate members 10 and 12 remain in contact with the lower rung 20 of the ladder.

FIG. 2 is a top view of the spacer 14 which is attached to and extends between the elongate members 10 and 12. This figure also illustrates in top view a typical container 30 as supported by the container support device comprising the invention. More specifically, typical containers such as paint containers include around the periphery and near the upper end thereof, bail or handle attachment members 32 and 34. The dimensions of the container support device are selected such that the container 30 fits within the curved opening 26 in the front edge of the spacer with the handle attachment devices 32 and 34 resting in the notched portions 22 and 24. Thus, as the angle of the container support device changes as a result of positional changes in the ladder to which it is attached, the container rotates in the notches 22 and 24 to maintain the container in a vertical position. By properly adjusting the positions of notches 22 and 24 with respect to the other portions of the container support device, it is practical to change the angular position of the ladder from vertical to essentially horizontal without spilling the contents (such as paint) from the container 30.

FIG. 3 illustrates an adapter designed to permit the container support device to be utilized to support containers having a lesser diameter than a gallon bucket, wherein the handle attachment brackets 32 and 34 are more closely spaced than the container support notches 22 and 24. More specifically, the adapter device illustrated in FIG. 3 includes a ring member 36 having attached thereto first and second outwardly extending portions 38 and 40, which are adapted to be positioned in the container support of notches 24 and 22 of the container support device. Extending downwardly from the ring member 36 and attached thereto is a generally U-shaped member 42, which is adapted to and provides support for a container positioned within the ring member 63 and supported by U-shaped member 42. By properly selecting the dimensions of circular member 36, containers having a diameter less than the distance between the container support notches 22 and 14 can be supported. In addition, gallon buckets having no bail ears can be supported in the invented device by using a properly sized adapter.

FIG. 4 illustrates how the container support device can be formed from a single piece of sheet metal. In manufacturing of the container support device, a sheet metal stamping 45 is first made. The sheet metal stamping 45 is then bent along dotted lines 48 and 50. After bending, the notched portions, indicated at reference numerals 52 and 54, extend downwardly to form the notches for supporting the device on the upper rung of the ladder. Second notches 56 and 58 extend upwardly to provide the notches for supporting the container. The portion 60 generally positioned between the dotted lines 48 and 50 forms the top structure of the container support device with the container being positioned generally within the backward extending curved portion 62.

In the embodiment of the invention illustrated in FIG. 5, the support device is made by bending a piece of wire, metal rod or similar elongated material and attaching the ends together. Other techniques neither described nor illustrated may also be used to construct other embodiments within the scope of the invention.

What is claimed is:

1. A container support device, attachable to a rung of a ladder having a plurality of rungs, for supporting a container in a vertical position in any operative angular position of the ladder, said container support device comprising:

a top portion forming a pair of spaced container support arms and having an inwardly extending curved edge between said support arms;

a pair of spaced ladder-rung hook members fixed to and depending from said top portion;

a pair of spaced upright elongate members fixed to and depending from said top portion, and adapted to contact a next lower rung from that engaged by said hook members; and upwardly open container receiving notches at the extremity of each arm;

whereby said container support device is laterally stable, and said support arms are generally horizontally oriented in the operative position on a ladder.

2. A container support device according to claim 1, further comprising an adapter for engagement with said notches, said adapter comprising a ring member, a downwardly extending U-shaped member depending from and connected to said ring member at opposite points thereof, and adapted to receive a container, and a pair of opposed outwardly extending members adapted for removable engagement in said notches.

* * * * *